US007494163B2

(12) United States Patent
Monts de Oca

(10) Patent No.: US 7,494,163 B2
(45) Date of Patent: Feb. 24, 2009

(54) FLUSH BOLT WITH FLIPLOCK

(76) Inventor: Jerry L. Monts de Oca, 12421 Citation Rd., Spring Hill, FL (US) 34610-4823

( * ) Notice: Subject to any disclaimer, the term of this patent is extended or adjusted under 35 U.S.C. 154(b) by 0 days.

(21) Appl. No.: 11/184,192

(22) Filed: Jul. 19, 2005

(65) Prior Publication Data

US 2007/0029812 A1 Feb. 8, 2007

(51) Int. Cl.
*E05C 1/06* (2006.01)
*E05C 1/02* (2006.01)

(52) U.S. Cl. ..... 292/143; 292/139; 292/DIG. 21

(58) Field of Classification Search ..... 292/137, 292/139, 143, DIG. 21, DIG. 46
See application file for complete search history.

(56) References Cited

U.S. PATENT DOCUMENTS

| | | | | | |
|---|---|---|---|---|---|
| 154,616 | A | * | 9/1874 | Peyer | 292/139 |
| 1,116,617 | A | * | 11/1914 | Page | 292/139 |
| 2,815,975 | A | * | 12/1957 | Check et al. | 292/143 |
| 2,819,107 | A | * | 1/1958 | Muessel | 292/143 |
| 3,556,573 | A | * | 1/1971 | Miller | 292/143 |
| 3,680,901 | A | * | 8/1972 | Biebuyck | 292/36 |
| 4,005,886 | A | | 2/1977 | Lirette | |
| 4,049,304 | A | | 9/1977 | Imhoff | |
| 4,058,332 | A | | 11/1977 | DiFazio | |
| 4,283,882 | A | | 8/1981 | Hubbard et al. | |
| 4,315,647 | A | * | 2/1982 | Wilzig et al. | 292/143 |
| 4,445,717 | A | | 5/1984 | Imhoff | |
| 5,004,277 | A | * | 4/1991 | Campbell et al. | 292/166 |
| 5,076,620 | A | | 12/1991 | Campbell et al. | |
| 5,127,690 | A | | 7/1992 | Kim et al. | |
| 5,335,450 | A | | 8/1994 | Procton | |
| 5,857,291 | A | | 1/1999 | Headrick | |
| D429,619 | S | | 8/2000 | Monts de Oca | |
| D438,445 | S | | 3/2001 | Monts de Oca | |
| 6,409,231 | B1 | * | 6/2002 | Rusiana | 292/33 |
| 6,453,616 | B1 | | 9/2002 | Wright | |
| 6,457,751 | B1 | | 10/2002 | Hartman | |
| 6,491,326 | B1 | * | 12/2002 | Massey et al. | 292/162 |
| 6,883,837 | B1 | | 4/2005 | Lin | |

* cited by examiner

*Primary Examiner*—Patricia L Engle
*Assistant Examiner*—Alyson M Merlino
(74) *Attorney, Agent, or Firm*—Larson & Larson; Frank Liebenow

(57) ABSTRACT

A flush bolt with improved travel is disclosed. The flush bolt is composed of a housing with a slotted longitudinal cavity in its face and a bore at least partially through one end of the housing and passing far enough through the housing as to engage with the slot. A bolt is within the bore and a coupling lever is rotatably coupled to a bolt at one end and to a slotted actuator arm at a centrally located point. The slotted actuator arm is coupled at one end to the housing at a point centrally located within the longitudinal cavity so that when pivoted, the slotted actuator arm transfers its pivotal movement to angular movement in the coupling lever and, in turn, into linear motion of the bolt.

32 Claims, 8 Drawing Sheets

FLUSH BOLT WITH FLIPLOCK

BACKGROUND OF THE INVENTION

1. Field of the Invention

This invention relates to the field of double door locking and more particularly to flush bolt assemblies for locking the inactive door of the double door in place.

2. Description of the Related Art

A flush bolt is used to lock the inactive door of a double door in place. In general, the flush bolt has a bolt that is extended from a top edge, bottom edge or both edges of the inactive door into a hole or receptacle within the doorframe or door sill, thereby locking the inactive door in position. Double doors have become popular for entryways into homes and businesses whereas both doors are opened when large objects must pass through, e.g., when moving furniture, and the inactive door locked in place and the active door used to allow entry of people. However, due to their surface area, double doors have a greater risk of failure due to high winds. During high winds, the double doors tend to flex inwardly and outwardly causing failure along the separation between the doors which is only supported by a door latch and perhaps a deadbolt lock. Furthermore, if the inactive door is inadequately bolted in place, undesired access is possible by an intruder placing inward force at the center of the doors.

Without at least one flush bolt, the structure and security of the double door would be compromised, in that a small force on the doors would override the door latch and/or deadbolt, providing little resistance to wind or burglary. Flush bolts have long been used to lock the inactive door in place, but prior designs have their limitations. Many flush bolts provide a first sliding bolt to lock the inactive door that extends upwardly into the doorframe header and a second sliding bolt extending downwardly into the doorframe sill.

Problems with existing flush bolts occur when the bolts are not locked in place or where the bolts do not extend sufficiently into the doorframe. If the flush bolts do not lock in place, a burglar may easily defeat the bolt by pushing it out of the door frame, thereby allowing the double doors to open by providing a small force inwardly, defeating the door latch and/or deadbolt lock. If the distance in which the bolt penetrates the doorframe is insufficient, the double door may fail during wind or when pushed inwardly. It has been shown that at least two inches of penetration is necessary to prevent the doors from opening during hurricane force winds and several locations in hurricane-prone areas have implemented building codes requiring at least two inches of penetration. Furthermore, as the travel of the bolt increases, friction from the hole or receptacle within the doorframe and/or the door sill makes it increasingly more difficult to engage or release the bolt.

An example of a flush bolt is described in U.S. Pat. No. 6,453,616 to Wright overcomes some of these limitations by screwing the bolt in its extended or retracted position, thereby providing some resistance to burglary. Unfortunately, this requires tools to remove the screws and retaining the screws for later relocking, not something that is readily available in many businesses and homes. Another example is described in U.S. Pat. No. 5,857,291 to Headrick that provides a bolt attached to a handle for moving the bolt between an extended position and a retracted position. This flush bolt provides little resistance to burglary since a thin object can easily be wedged between the inactive and active doors to move the bolt into its retracted position. Another example described in U.S. Pat. No. 6,457,751 to Hartman describes a locking flush bolt using a spring and notch. This provides minimum security and almost no leverage in engaging or disengaging the flush bolt.

What is needed is a flush bolt that will provide a bolt that will pierce the doorframe/sill sufficiently as to provide increased resistance to wind damage while providing leverage to assist in piercing the doorframe and a locking mechanism to prevent unwanted deactivation.

SUMMARY OF THE INVENTION

In one embodiment, flush bolt adapted for mounting on a door and operating between an engaged position with a securing surface and a disengaged position is disclosed including a housing adapted to fit within a channel of a door. The housing has a face externally exposed when it is within the channel, screw holes for affixing the housing to the door and a longitudinal bore in the housing, starting at a first end of the housing and running parallel to the face of the housing. The bore extends through at least a portion of the housing. Included is a bolt slideably adapted within the longitudinal bore with an engagement end for engaging with the securing surface and a distal connection end. A cavity is in the face of the housing and a slotted actuator arm that has a first end and a second end is hingedly coupled at its first end to the housing at a point within the cavity. A coupling lever passes through the slotted actuator arm and through a longitudinal slot in the cavity. The coupling lever is rotatably coupled to the slotted actuator arm and an end of the coupling lever is rotatably coupled to the distal connection end of the bolt so that rotation of the slotted actuator arm transfers angular movement to the coupling lever and results in a linear movement of the bolt.

In another embodiment, a method of making a flush bolt adapted for mounting on a door and operating between an engaged position with a securing surface and a disengaged position is disclosed including forming a housing and drilling a longitudinal bore in the housing; forming a longitudinal cavity in the housing; forming a longitudinal slot in the longitudinal cavity; forming a bolt with an engagement end and a distal connection end; forming a slotted actuator; and forming a coupling lever. The distal connection end of the bolt is inserted into the longitudinal bore, passing far enough into the longitudinal bore so that the distal connection end is accessible through the longitudinal slot in the longitudinal cavity. The distal connection end is rotatably coupled to a first end of the coupling lever. A second end of the coupling lever is passed through a slot in the slotted actuator and the slotted actuator is coupled to the coupling lever. A first end of the slotted actuator is coupled to the longitudinal cavity and the second end of the slotted actuator is left free to rotate or pivot and engage or disengage the bolt.

In another embodiment, an apparatus for locking a door, operating between an engaged position with a securing surface and a disengaged position is disclosed including a housing adapted to fit within a channel of the door and having a face externally exposed when within the channel. The housing has holes for accepting screws that affix the housing to the door and has a longitudinal bore positioned centrally starting at a first end of the housing. The longitudinal bore is parallel to the face of the housing and extends through at least a portion of the housing. A bolt is slideably adapted within the longitudinal bore and has an engagement end for engaging with the securing surface and a distal connection end. A cavity is cut in the face of the housing and a slotted actuator arm having a first end and a second end is rotatably coupled to the housing within the cavity at its first end by pins or set screws. A coupling lever passes through the slotted actuator arm and through a longitudinal slot in the cavity. The coupling lever is rotatably coupled to the slotted actuator arm by a second pin and an end of the coupling lever is rotatably coupled to the distal connection end of the bolt by a third pin, whereas rotation of the slotted actuator arm transfers angular movement to the coupling lever and results in a linear movement of the bolt.

In another embodiment, a double door system is disclosed including a door frame with an inactive door hingedly coupled to the door frame at a longitudinal edge. At least one flush bolt is mounted in the inactive door on a second longitudinal edge, having a housing adapted to fit in a door cavity within the second longitudinal edge and has a face externally exposed when the housing is within the door cavity. The housing is attached to the door by one or more screws or fasteners. The housing has a longitudinal bore starting at a first end of the housing, parallel to the face of the housing and extending through at least a portion of the housing. A bolt is slideably adapted within the longitudinal bore and has an engagement end for engaging with a securing surface and a distal connection end. A cavity is cut in the face of the housing. A slotted actuator arm with a first end and a second end is rotatably coupled to the housing within the cavity at its first end by pins or set screws. A coupling lever passes through the slotted actuator arm and through a longitudinal slot in the cavity. The coupling lever is rotatably coupled to the slotted actuator arm by a second pin and an end of the coupling lever is rotatably coupled to the distal connection end of the bolt by a third pin, whereas rotation of the slotted actuator arm transfers angular movement to the coupling lever and results in a linear movement of the bolt.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
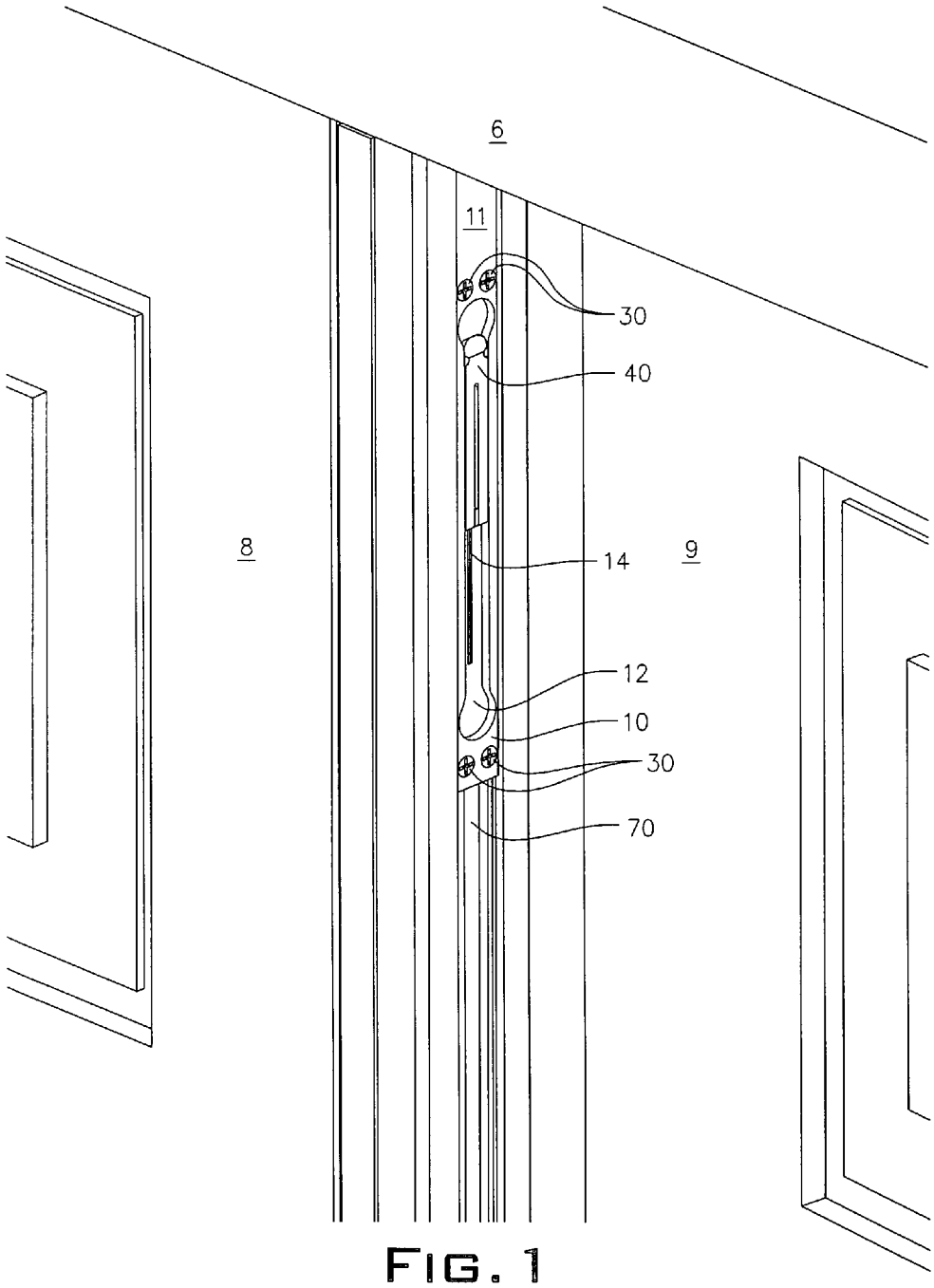
FIG. 1 illustrates a double door with a flush bolt at the top of the inactive door of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a double door with a flush bolt at the top of the inactive door of a first embodiment of the present invention is shown. The flush bolt 11 is within a channel 70 within the inactive door 8. The active door 9 is shown partially open. The flush bolt 11 is secured in place by fasteners or screws 30. Although four screws 30 are shown, any number of screws 30 is possible, including one or two. The flush bolt 11 has a frame or housing face 10 with a depression or cavity 12 for holding the slotted actuator arm 40 so that the slotted actuator arm 40 is flush with the housing face 10 when in its engaged position (shown) and when in its disengaged position (not shown), thereby not interfering with the opening or closing of the active door 9. Also visible is a longitudinal slot 14 which is described later and the door frame 6.

Figure 2:
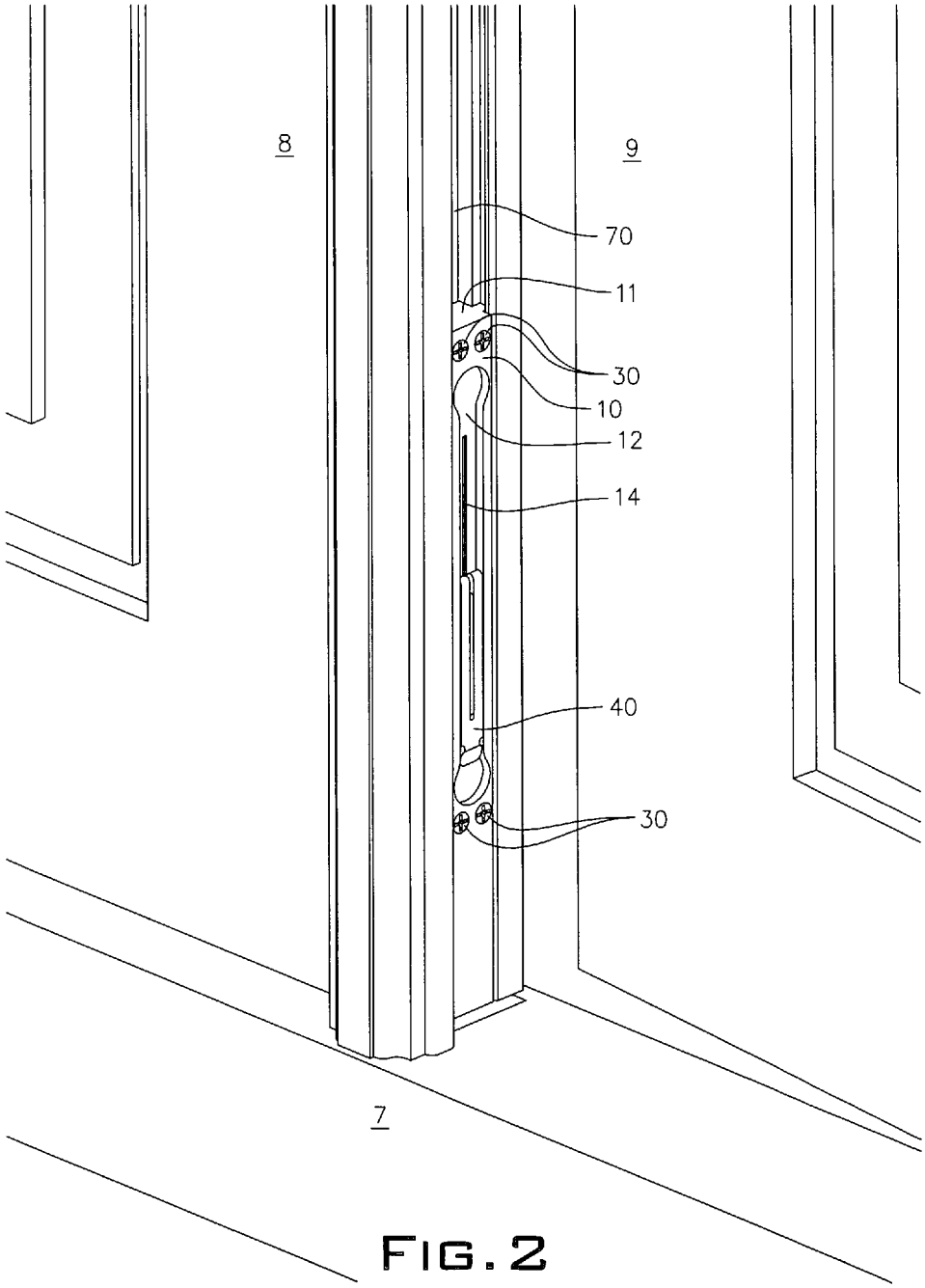
FIG. 2 illustrates a double door with a flush bolt at the bottom of the inactive door of the first embodiment of the present invention.

Referring to FIG. 2, a double door with a flush bolt at the bottom of the inactive door of the first embodiment of the present invention is shown. The flush bolt 11 is within a channel 70 within the inactive door 8. The active door 9 is shown partially open. The flush bolt 11 is secured in place by screws 30. Although four screws 30 are shown, any number of screws 30 is possible, including one or two. The flush bolt 11 has a housing face 10 with a depression or cavity 12 for holding the slotted actuator arm 40 so that the slotted actuator arm 40 is flush with the housing face 10 when in its engaged position (shown) and when in its disengaged position (not shown), thereby not interfering with the opening or closing of the active door 9. Also visible is a longitudinal slot 14 which is described later and the door sill 7.

Although the channel 70 is shown in FIG. 1 and FIG. 2 extending beyond the flush bolt 11, in some embodiments the channel 70 is sized to fit the flush bolt 11, perhaps by routing the edge of the inactive door 8.

Figure 3:
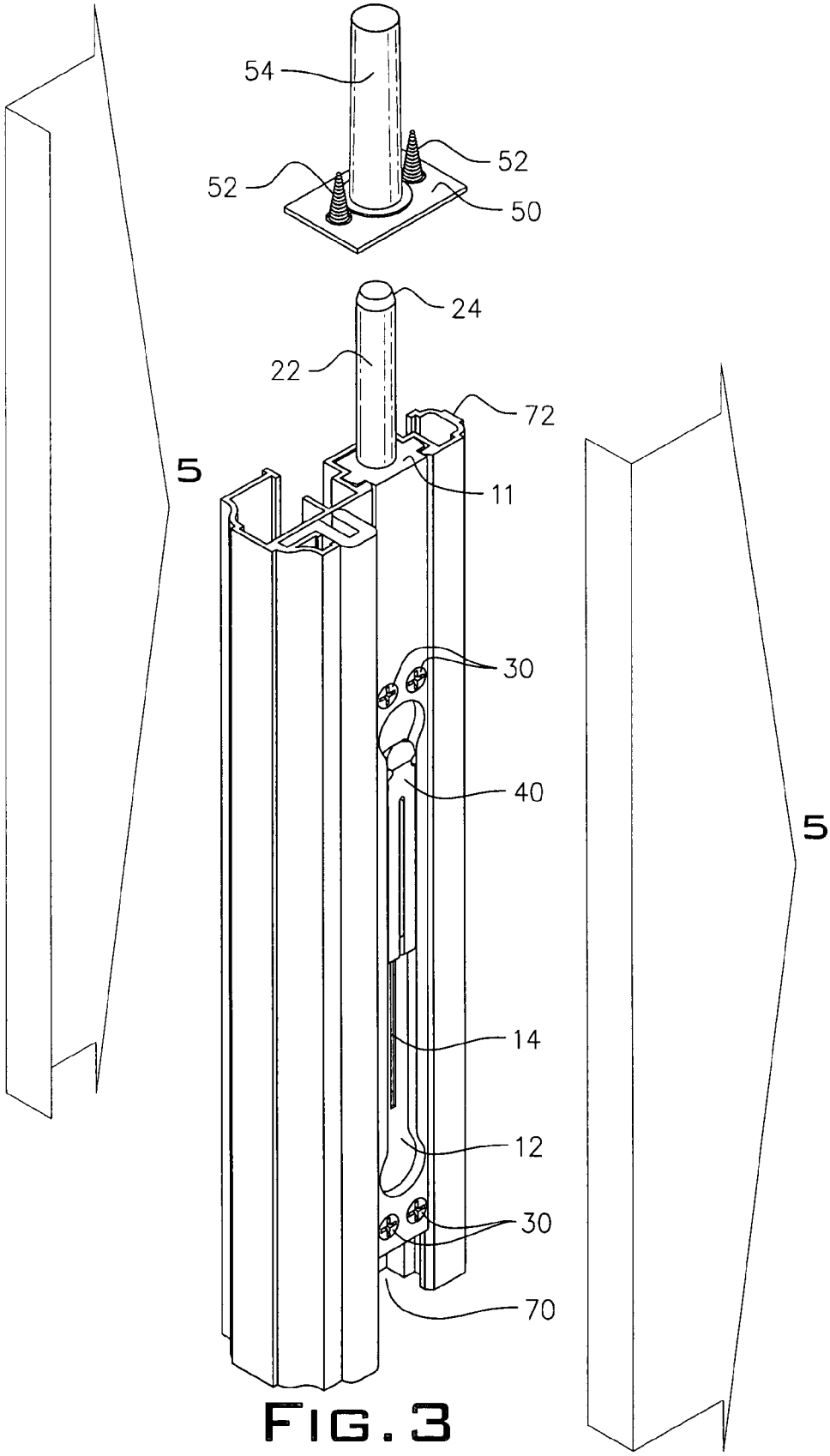
FIG. 3 illustrates a flush bolt and channel of the first embodiment of the present invention.

Referring to FIG. 3, a flush bolt and channel of the first embodiment of the present invention is shown. In one embodiment, the channel 70 is formed within an extruded or molded metal door edge 72 and affixed to the interfacing edge of the inactive door 8. In other embodiments, the channel 70 is formed in the inactive door during the construction of the door (not shown) or the channel formed by routing out the edge of the door. Although the flush bolt 11 is shown with flat ends, in some embodiments the ends are rounded to fit within a routed channel within the edge of the inactive door 8.

The flush bolt 11 is shown in its engaged position, having a bolt 22 with a tapered end 24 extending out of the flush bolt 11. When engaged (as shown), the bolt would pass into a hole within the door frame or the door sill, thereby securing the door from being opened. When not engaged, the bolt 22 retracts into a bore 28 (not visible—see FIG. 4) within the housing 11 far enough to allow the inactive door 8 to open. Although in some installations, the bolt would pass into a bare hole in the door frame, an alternate as shown uses a receptor 54 with a face plate 50 that is held in place with a number of fasteners or screws 52, providing enhanced security.

The flush bolt 11 is held in place in the channel 70 by a number of fasteners or screws 30. The slotted actuator 40 is shown flush within the cavity 12 and the longitudinal slot 14 is visible.

Figure 4:
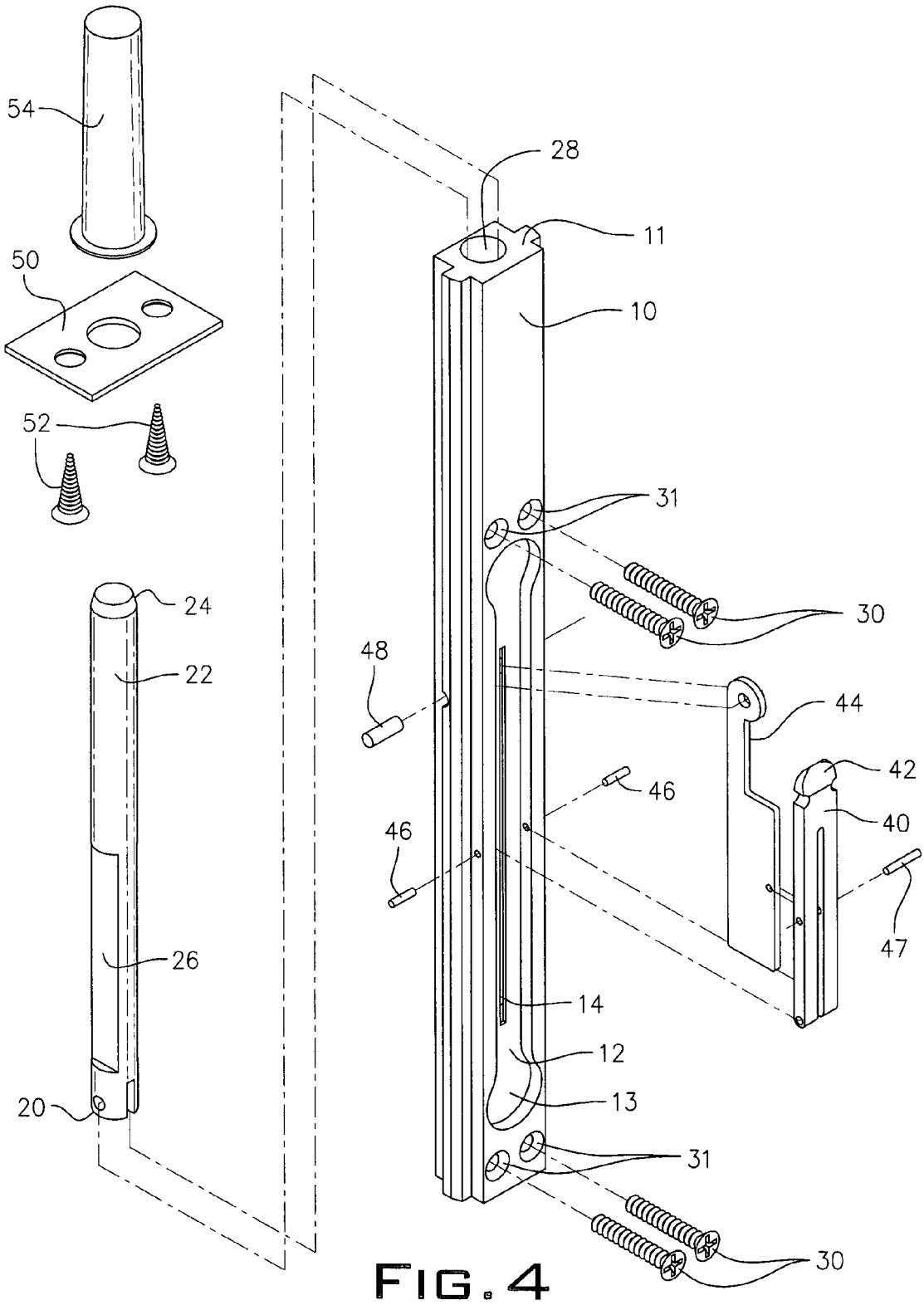
FIG. 4 illustrates an exploded view of the first embodiment of the present invention.

Referring to FIG. 4, an exploded view of the first embodiment of the present invention is shown. The optional receptor 54, plate 50 and fasteners 52 are shown for completeness.

The flush bolt housing 11 is held in place within the channel 70 (not shown) by one or more fasteners 30 passing through an equal number of holes 31 in the flush bolt housing 11. In some embodiments, the holes 31 are countersunk, allowing a flat-headed screw heads to be virtually flush with the flush bolt face 10 when tightened.

In the flush bolt face 10 is a cavity 12 sized to accept the slotted actuator arm 40 in both engaged and disengaged positions. In some embodiments, the cavity 12 extends further than the travel of the slotted actuator arm 40 providing a finger pull area 13. In some embodiments, the slotted actuator arm 40 has a tapered finger pull 42 at one end to make it easier to pry out of the cavity 12. The slotted actuator arm 40 is rotatably coupled at the other end to the flush bolt housing 11 by pins or set screws 46. In this embodiment, there is one pin or set screw 46 for each side of the slotted actuator arm 40 and each pin or set screw passes through the housing 11 and into the slotted actuator arm 40. In some embodiments, the holes for accepting the pins are sized so that the slotted actuator arm 40 rotates easily, perhaps having a tight fit in the slotted actuator arm 40 and a loose fit in the housing 11 or visa versa. In some embodiments, half dog point set screws are used.

At a point near the center of the slotted actuator arm 40, another pin 47 passes through the slotted actuator arm 40 and through a coupling lever 44 providing a rotatable coupling between them. The pin 47 passes through the coupling lever 44 at a point designed such that in the engaged position, an edge the coupling lever 44 rests within the slot of the slotted actuator arm 40. One end of the coupling lever passes through the longitudinal slot 14 and is rotatably coupled to the distal end 20 of the bolt 22 by a third pin 48, the bolt positioned within a bore 28 within the flush bolt housing 11. Thereby coupling the bolt 22 to the slotted actuator arm 40 so that as the slotted actuator arm 40 is rotated or pivoted between the engaged position and the disengaged position, the coupling lever 44 converts to rotational movement into angular movement and translates the angular movement into a linear movement of the bolt 22 and the bolt 22 slides from a position extending beyond the bore 28 to a position where the bolt 22 is substantially within the bore 28 and visa versa. Although there is no limit to the overall travel of the bolt 22, in some embodiments, the bolt 22 extends at least 2 inches beyond the top edge of the flush bolt housing 11 when in the engaged position.

In some embodiments, the bolt 22 is tapered at one end 24 to improve registration with the hole in the doorframe/sill.

In some embodiments, the holes 31 in the area of the bore 28 interfere with the bolt 22. In this embodiment, the bolt 22 is narrowed 26 to prevent interference with fasteners 30 when installed within the holes 31 surrounding the bolt 22. In an alternate embodiment in which one hole 31 is centrally made, instead of narrowing the bolt 22, a slot (not shown) is cut in the bolt 22 wide enough for the fastener 31 to pass through the slot and not interfere with the bolt 22.

Figure 5:
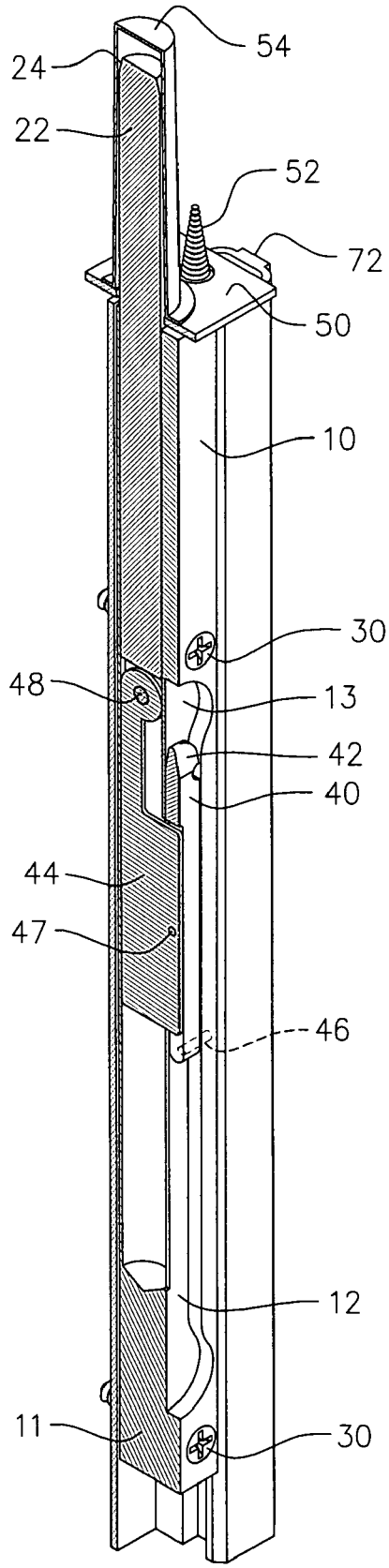
FIG. 5 illustrates a cross section along line 5-5 of FIG. 3 of the first embodiment of the present invention.

Referring to FIG. 5, a sectional view of the first embodiment of the present invention is shown. The extruded or molded metal door edge 72 and affixed to the interfacing edge of the inactive door 8 (not shown) is visible. The optional striker plate 50, receptor 54 and striker plate screws 52 are visible. These are mounted within the door frame 6 (not shown in FIG. 5) of door sill 7 (not shown in FIG. 5).

The bolt 22 is shown in its engaged position with the tapered tip 24 substantially within the receptor 54. The opposite end of the bolt 22 is rotatable coupled to the coupling lever 44 by a pin 48. The coupling lever 44 is rotatably attached to the slotted actuator arm 40 by another pin 47 and the slotted actuator arm 40 is rotatably coupled to the flush bolt housing by pins or set screws 46 (not visible in FIG. 5 but shown with dotted lines) at a point centrally located within the cavity 12 cut in the face 10 of the flush bolt housing 11. The optional tapered end 42 of the slotted actuator arm 40 and finger pull area 13 are shown and assist a user in getting a finger under the slotted actuator arm 40 to engage or disengage the bolt 22. Two fasteners 30 are shown as well.

Figure 6A:
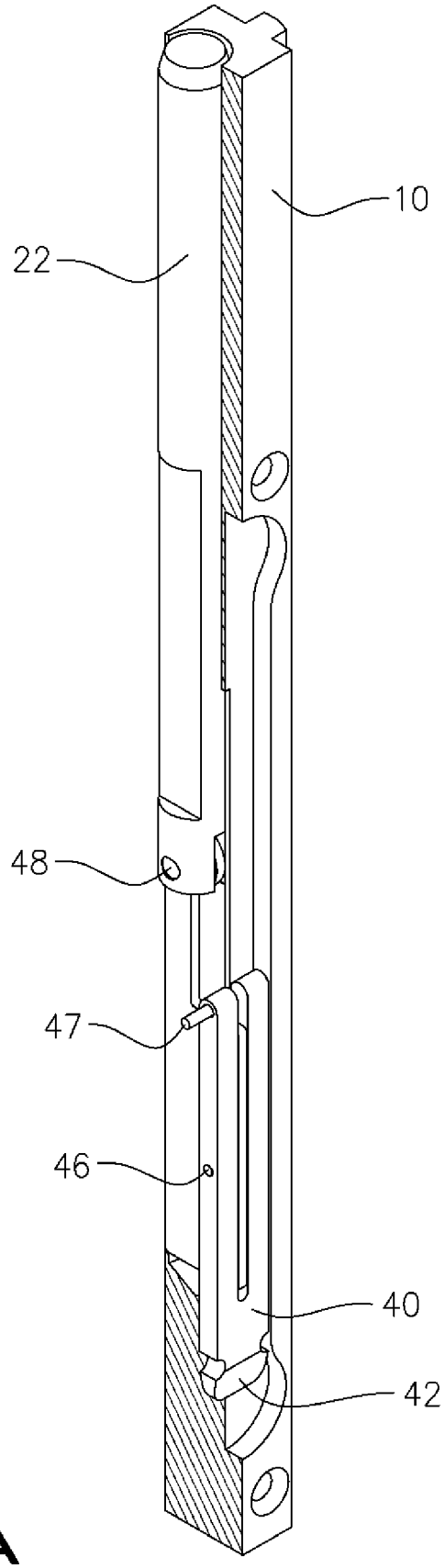
FIG. 6A illustrates a cross section along line 5-5 of FIG. 3 of the first embodiment of the present invention showing the bolt in a retracted position.
Figure 6B:
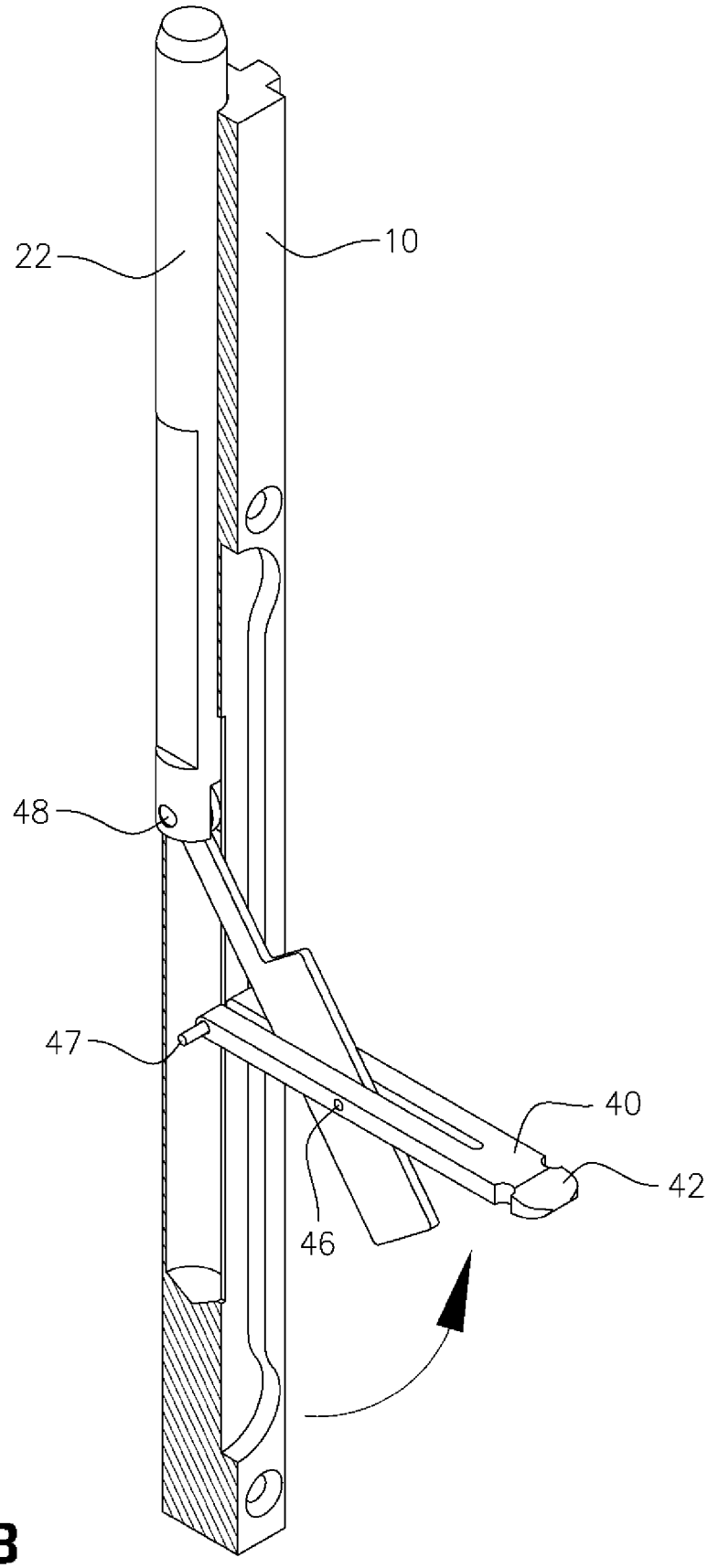
FIG. 6B illustrates a cross section along line 5-5 of FIG. 3 of the first embodiment of the present invention showing the bolt in a transitional position.
Figure 6C:
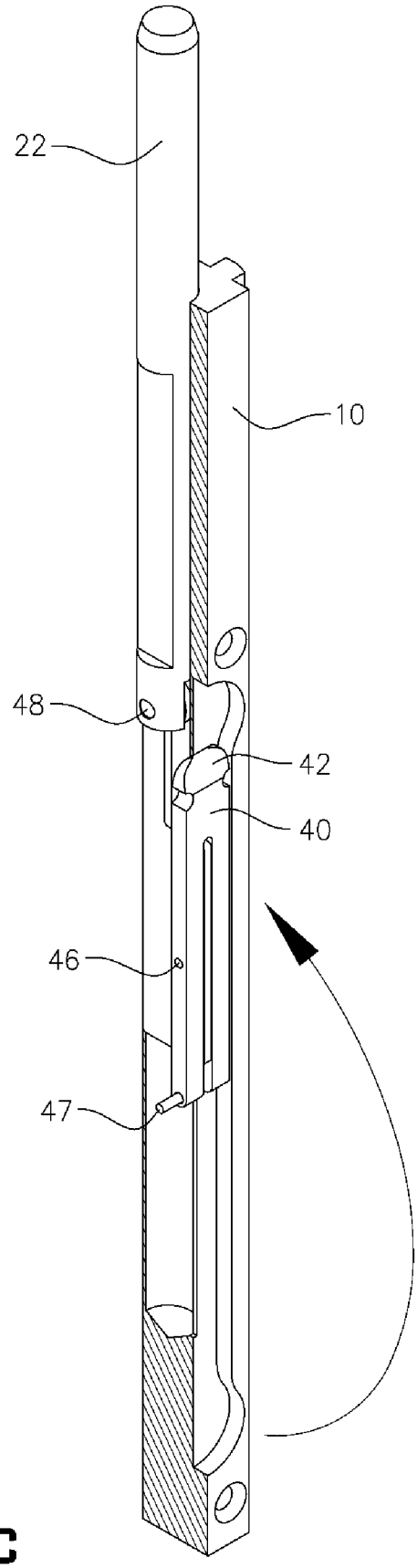
FIG. 6C illustrates a cross section along line 5-5 of FIG. 3 of the first embodiment of the present invention showing the bolt in an extended position.

Referring to FIGS. 6A-6C, a sectional view of the first embodiment of the present invention is shown transitioning from a retracted position to a position in which the bolt 22 is extended.

In FIG. 6A, the bolt 22 is shown in its retracted position. The slotted actuator arm 40 is positioned against the face 10 of the flush bolt housing 11 in a downward position. In FIG. 6B, the slotted actuator arm 40 is lifted to a point approximately mid-travel. The coupling lever 44 lifts and pushes the bolt 22 partially out of the face 10 of the flush bolt housing 11. Referring to FIG. 6C, the slotted actuator arm 40 has completed its travel and is in an upward position resting against the face 10 of the flush bolt housing 11 with the bolt 22 fully extended.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A flush bolt adapted for mounting on a door and operation between an engaged position with a securing surface and a disengaged position, the flush bolt comprising:

a housing, the housing having a face externally exposed when the housing is affixed to an edge of the door, the housing having an attachment means for affixing the housing to the door, the housing having a longitudinal bore starting at a first end of the housing, the longitudinal bore parallel to the face of the housing and the longitudinal bore extending through at least a portion of the housing;

a bolt slideably adapted within the longitudinal bore, the bolt having an engagement end for engaging with the securing surface and a distal connection end;

a cavity in the face of the housing;

a slotted actuator arm having a distal end and a second end, the distal end hingedly coupled to the housing within the cavity, a slot of the slotted actuator arm extending from the distal end longitudinally to a point between a mid-point of the slotted actuator arm and the second end of the slotted actuator arm; and a coupling lever passing through the slotted actuator arm, the coupling lever passing through a longitudinal slot in the cavity, the coupling lever rotatably coupled to the slotted actuator arm at approximately the mid-point of the slotted actuator arm, an end of the coupling lever rotatably coupled to the distal connection end of the bolt, whereas rotation of the slotted actuator arm transfers angular movement to the coupling lever and results in a linear movement of the bolt;

whereas the door is protected from being forced open by high winds.

2. The flush bolt of claim 1, wherein the engagement end of the bolt is tapered.

3. The flush bolt of claim 1, wherein the cavity extends beyond the travel of the slotted actuator to provide a finger pull area.

4. The flush bolt of claim 1, wherein the second end of the slotted actuator is tapered forming a finger pull to enable lifting from the cavity.

5. The flush bolt of claim 1, wherein the housing is made of aluminum.

6. The flush bolt of claim 1, wherein the flush bolt is adapted to mount in a channel and the channel is formed from extruded metal and the channel is affixed to the edge of the door.

7. The flush bolt of claim 6, wherein the attachment means is a plurality of screws passing through the face and through the housing and into the channel.

8. The flush bolt of claim 7, wherein at least one of said plurality of screws pass through the housing and at least partially through the longitudinal bore and the bolt is narrowed for a length of the bolt that passes the at least one of said screws.

9. The flush bolt of claim 1, wherein the flush bolt is adapted to mount in a channel carved in the edge of the door, wherein the edge of the door is made of a material selected from the group consisting of wood, fiberglass and metal.

10. The flush bolt of claim 1, wherein the securing surface is selected from the group consisting of a doorframe and a door sill.

11. The flush bolt of claim 1, wherein the distal end of the slotted actuator arm is hingedly coupled to the housing within the cavity by a pin.

12. The flush bolt of claim 11, wherein the slotted actuator arm is rotatably coupled to the coupling arm by a second pin.

13. The flush bolt of claim 12, wherein the coupling arm is rotatably coupled to the distal connection end of the bolt by a third pin.

14. An apparatus for locking a door, the apparatus operating between an engaged position with a securing surface and a disengaged position, the apparatus comprising:

a housing adapted to affix to an edge of the door, the housing having a face externally exposed when the housing is affixed to the edge of the door, the housing having an attachment means for affixing the housing to the door, the housing having a longitudinal bore starting at a first end of the housing, the longitudinal bore parallel to the face of the housing and the longitudinal bore extending through at least a portion of the housing;

a bolt means slideably adapted within the longitudinal bore, the bolt means having an engagement end for engaging with the securing surface and a distal connection end;

a cavity in the face of the housing;

a slotted actuator arm having a distal end and a second end, a slot of the slotted actuator arm extending from the distal end longitudinally to a point between a mid-point of the slotted actuator arm and the second end of the slotted actuator arm, the distal end rotatably coupled to the housing within the cavity by a pin means; and a coupling lever passing through the slotted actuator arm, the coupling lever passing through a longitudinal slot in the cavity, the coupling lever rotatably coupled to the slotted actuator arm at approximately the mid-point of the slotted actuator arm by a second pin means, an end of the coupling lever rotatably coupled to the distal connection end of the bolt by a third pin means, whereas rotation of the slotted actuator arm transfers angular movement to the coupling lever and results in a linear movement of the bolt;

whereas the door is protected from being forced open by high winds.

15. The apparatus of claim 14, wherein the engagement end of the bolt is tapered.

16. The apparatus of claim 14, wherein the cavity extends beyond the travel of the slotted actuator to provide a finger pull area.

17. The apparatus of claim 14, wherein the attachment means is a plurality of screws passing through the face and through the housing and into the edge of the door.

18. The apparatus of claim 17, wherein at least one of the plurality of screws pass through the housing and pass at least partially through the longitudinal bore and the bolt is narrowed for a length of the bolt that passes the at least one of said plurality of screws.

19. The apparatus of claim 14, wherein the second end of the slotted actuator is tapered to enable finger pulling from the cavity.

20. The apparatus of claim 14, wherein the housing is made of aluminum.

21. The apparatus of claim 14, wherein the flush bolt is adapted to mount within a channel formed from extruded metal and the channel is affixed to the edge of the door.

22. The apparatus of claim 14, wherein the door is an inactive door of a double-door set and the flush bolt is adapted to mount within a channel within the edge of the inactive door and the edge of the inactive door and the inactive door is made from a material selected from the group consisting of wood, fiberglass and metal.

23. The apparatus of claim 14, wherein the securing surface is selected from the group consisting of a door frame and a door sill.

24. A double door system comprising:

a door frame;

an inactive door hingedly coupled to the door frame at a longitudinal edge;

a flush bolt mounted in the inactive door on a second longitudinal edge, the flush bolt comprising:

a housing, the housing adapted in a door cavity within the second longitudinal edge, the housing having a face externally exposed when the housing is within the door cavity, the housing having an attachment means for affixing the housing to the second longitudinal edge, the housing having a longitudinal bore starting at a first end of the housing, the longitudinal bore parallel to the face of the housing and the longitudinal bore extending through at least a portion of the housing;

a bolt means slideably adapted within the longitudinal bore, the bolt means having an engagement end for engaging with a securing surface and a distal connection end;

a cavity in the face of the housing;

a slotted actuator arm having a distal end and a second end, a slot of the slotted actuator arm extending from the distal end longitudinally to a point between a mid-point of the slotted actuator arm and the second of the slotted actuator arm, the distal end rotatably coupled to the housing within the cavity by a pin means; and a coupling lever passing through the slotted actuator arm, the coupling lever passing through a longitudinal slot in the cavity, the coupling lever rotatably coupled to the slotted actuator arm at approximately the mid-point of the slotted actuator arm by a second pin means, an end of the coupling lever rotatably coupled to the distal connection end of the bolt by a third pin means, whereas rotation of the slotted actuator arm transfers angular movement to the coupling lever and results in a linear movement of the bolt.

25. The double door system of claim 24, wherein the securing surface is selected from the group consisting of a door frame and a door sill.

26. The double door system of claim 24, wherein the engagement end of the bolt is tapered.

27. The double door system of claim 24, wherein the cavity extends beyond the travel of the slotted actuator to provide a finger pull area.

28. The double door system of claim 24, wherein the attachment means is a plurality of screws passing through the face and through the housing and into a channel in the inactive door.

29. The double door system of claim 28, wherein at least one of the plurality of screws pass through the housing and pass at least partially through the longitudinal bore and the bolt is narrowed for a length of the bolt that passes the at least one of said plurality of screws.

30. The double door system of claim 24, wherein the second end of the slotted actuator is tapered to enable finger pulling from the cavity.

31. The double door system of claim 24, wherein the housing is made of aluminum.

32. The double door system of claim 24, wherein the pin means is selected from the group consisting of pins and set screws.

* * * * *